US006834448B2

(12) United States Patent
Hanafusa

(10) Patent No.: US 6,834,448 B2
(45) Date of Patent: Dec. 28, 2004

(54) SNOW REMOVAL MACHINE

(75) Inventor: Jitsumi Hanafusa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/739,967

(22) Filed: Dec. 18, 2003

(65) Prior Publication Data

US 2004/0139631 A1 Jul. 22, 2004

(30) Foreign Application Priority Data

Jan. 21, 2003 (JP) ..... 2003-012732
Jan. 21, 2003 (JP) ..... 2003-012745
Aug. 20, 2003 (JP) ..... 2003-208118

(51) Int. Cl.[7] ..... E01H 5/09
(52) U.S. Cl. ..... 37/223; 37/248
(58) Field of Search ..... 37/223, 222, 219, 37/244–262

(56) References Cited

U.S. PATENT DOCUMENTS 5,713,323 A * 2/1998 Walsh et al. ..... 123/184.42

FOREIGN PATENT DOCUMENTS

JP 64021108 1/1989

* cited by examiner

*Primary Examiner*—Christopher J. Novosad
(74) *Attorney, Agent, or Firm*—Adams & Wilks

(57) ABSTRACT

A snow removal machine of this invention has a machine body, a snow removing section mounted on the machine body for removing snow while the snow removal machine travels along a ground surface, and a running section mounted on the machine body for undergoing movement to cause the snow removal machine to travel along the ground surface. An engine is mounted on the machine body for driving the snow removing section. An oil filler supplies oil to the engine. A fuel cock opens and closes a fuel line supply to the engine. A spark plug ignites a fuel mixture within the engine. A cover has a first cover portion and a second cover portion. A connecting structure connects the second cover portion to the first cover portion to cover the engine, the oil filler, the fuel cock and the spark plug and allows disconnection of the second cover portion from the first cover portion to expose and provide access to the engine, the oil filler, the fuel cock and the spark plug.

20 Claims, 12 Drawing Sheets

SNOW REMOVAL MACHINE

FIELD OF THE INVENTION

The present invention relates to snow removal machines provided at the front of the body with a snow removing section such as an auger for removing snow.

BACKGROUND OF THE INVENTION

A known snow removal machine with of an auger is disclosed, for example, in Japanese Patent Laid-Open Publication No. SHO-64-21108. This snow removal machine will be described with reference to FIG. 12.

A conventional snow removal machine 200 shown in FIG. 12 includes a machine body 201, an engine 202 provided on the machine body 201, a cover 203 covering the engine 202, an auger 204 and a blower 205 provided at the front of the machine body 201 and driven by the engine 202, and a crawler-type running section 206 driven by the engine 202. The snow removal machine 200 travels forward while collecting snow with the auger 204, whirling up the collected snow with the blower 205, and throwing the snow away to a desired position with a chute 207.

An oil filler, a fuel cock for opening and closing a fuel line, a spark plug for igniting a fuel mixture in a cylinder and a battery for providing electric current to the spark plug are provided around the engine 202. These components are covered by the cover 203 because, if left bared, they can be adversely affected by snow, drops of water and the like.

The oil filler, fuel cock, spark plug and battery receive frequent maintenance. To facilitate the maintenance of those components, although not shown in FIG. 12, an opening is actually formed in the cover 203 in a position corresponding to the disposed position of the components and a door is openably and closably provided at the opening. The door is opened for the maintenance of the oil filler, fuel cock, spark plug and battery.

Components of the oil filler, fuel cock, spark plug and battery, however, are provided all around the engine 202. It is necessary to attach a door at the position of each component, resulting in a plurality of doors attached to the cover 203. The number of components of the cover 203 is thus increased, resulting in time-consuming assembly of the cover 203, which prevents cost reduction of the snow removal machine.

It is required to open and close the doors when maintenance of the components of the oil filler, fuel cock, spark plug and battery is done. Opening and closing the doors are troublesome. In this context, there is a demand for a snow removal machine which facilitates maintenance of components such as an oil filler, fuel cock, spark plug and battery and can reduce the number of components of a cover.

SUMMARY OF THE INVENTION

According to the present invention, there is provided a snow removal machine, which comprises: a machine body; a snow removing section provided at a front portion of the machine body; a blower provided between the machine body and the snow removing section; a running section provided below the machine body; an engine mounted to the machine body for driving the snow removing section and the blower; an oil filler, a fuel cock for opening and closing a fuel line, a spark plug for igniting a fuel mixture within a cylinder and a battery for providing electric current to the spark plug which are disposed around the engine; and a cover comprising an upper cover portion for covering the engine, oil filler, fuel cock, spark plug and battery, and a lower cover portion on which the upper cover portion is removably mounted; the upper cover portion being adapted to be removed from the lower cover portion thereby to expose the oil filler, fuel cock, spark plug and battery.

In this invention, as described above, the cover is split into two segments, the upper cover portion and the lower cover portion, and the upper cover portion covers the engine, oil filler, fuel cock, spark plug and battery, which components are exposed by removing the upper cover portion. With this configuration, only removing the upper cover portion from the lower cover portion allows the oil filler, fuel cock, spark plug and battery to be easily exposed, facilitating maintenance of those components. The configuration of splitting the cover into two segments, the upper and lower cover portions, eliminates the need for providing conventionally required maintenance doors at the cover. The number of components of the cover can thus be reduced for a simplified configuration.

The snow removal machine in this invention preferably further comprises: an oil drain hole provided at the engine; a drain pipe extended substantially horizontally from the oil drain hole in a transverse direction of the machine body; a drain plug removably fitted to an end of the drain pipe, the end of the drain pipe being protruded outside of a sidewall of the lower cover portion; an oil receiver formed at the lower cover portion in a position below the drain pipe for receiving oil turning around the end of the drain pipe to a periphery of the drain pipe; and a retaining hollow formed with the oil receiver and the lower cover portion for fitting a harness thereinto for retaining.

The drain plug can be removed from the outside of the cover without removing the upper cover portion and the lower cover portion. The formation of the oil receiver at the lower cover portion below the drain pipe allows the oil receiver to receive engine oil turning around the end of the drain pipe to the periphery. In addition, the formation of the retaining hollow with the oil receiver and the bottom surface of the lower cover portion and the fitting of a wire harness into the retaining hollow for retaining the wire harness allow members used for a component retaining a wire harness to be also used for an oil receiver.

The oil receiver preferably has a discharge opening formed in a bottom thereof for discharging the oil outside. Engine oil collected in the oil receiver can be easily discharged outside of the cover without removing the cover.

The snow removal machine in the present invention, more preferably, further comprises: a blower housing for enclosing the blower disposed at the front portion of the machine body; and a mount provided on an upper portion of the blower housing for mounting the battery; the upper cover portion being configured to extend forward so as to cover the battery mounted on the mount and the blower housing.

The battery is thus covered by the cover to prevent snow or rain from reaching the battery. The upper portion of the blower housing can also be covered by the cover to prevent outside leakage of frictional noise of air produced by rotation of the blower. The battery and the blower housing are covered by the upper cover portion extending forward of the machine body.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

FIGS. 1 to 7 illustrate a snow removal machine according to a first embodiment of the present invention.

Figure 1:
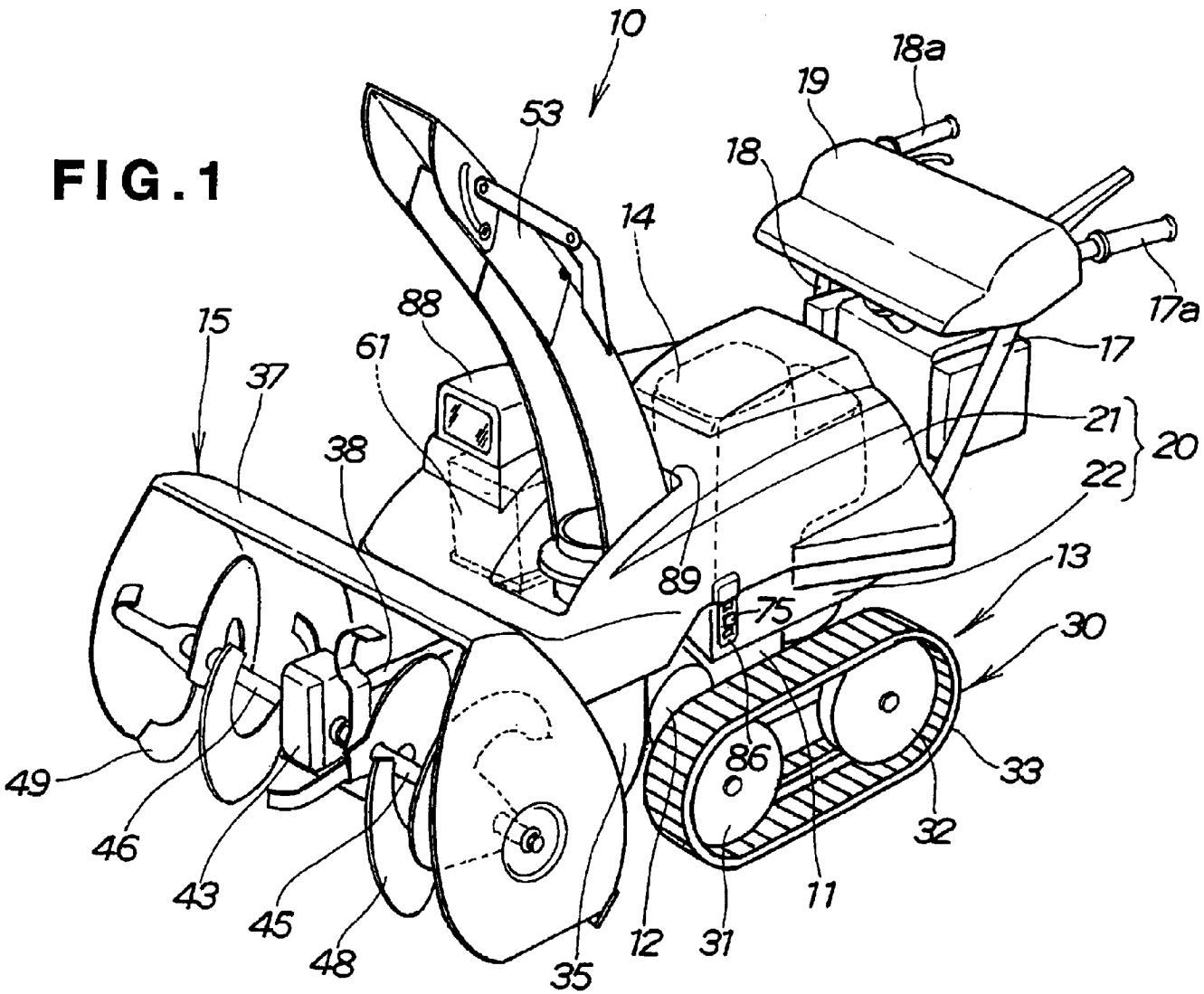
FIG. 1 is a perspective view of a snow removal machine according to a first embodiment of the present invention.

A snow removal machine 10 shown in FIG. 1 includes a machine body 11. The machine body 11 is made by a transmission case. Left and right drive electric motors 12 (only the left electric motor is shown) are mounted to lower left and right portions of the machine body 11. A running section 13 is connected to the left and right electric motors 12. An engine (drive source) 14 for snow removal is mounted on top of the machine body 11. An auger unit (snow removing section) 15 driven by the engine 14 is mounted to the front of the machine body 11. The rear of the auger unit 15 and the engine 14 are covered by a cover 20. Left and right operating handles 17, 18 extend rearward upward from upper portions of the machine body 11. An operating panel 19 is mounted between the left and right operating handles 17, 18.

The above snow removal machine 10 is a self-propelled walk-behind working machine lead by an operator holding grips 17*a*, 18*a* of the left and right operating handles 17, 18, waling behind the operating panel 19.

The running section 13 consists of a left running unit 30 provided outside the left electric motor 12 and a right running unit (not shown) provided outside the right electric motor (not shown). The right running unit has the same configuration as the left running unit 30 and will not be described.

The left running unit 30 has a left drive wheel 31 connected to the left electric motor 12, a left idler wheel 32 provided rotatably behind the left drive wheel 31, and a left crawler belt 33 running between the left drive wheel 31 and the left idler wheel 32. The left crawler belt 33 is rotated by driving the left drive wheel 31 with the left electric motor 12.

The snow removal machine 10 travels by rotating the left and right crawler belts 33 of the running section 13 with the left and right electric motors 12 while driving the auger unit 15 with the engine 14.

Figure 2:
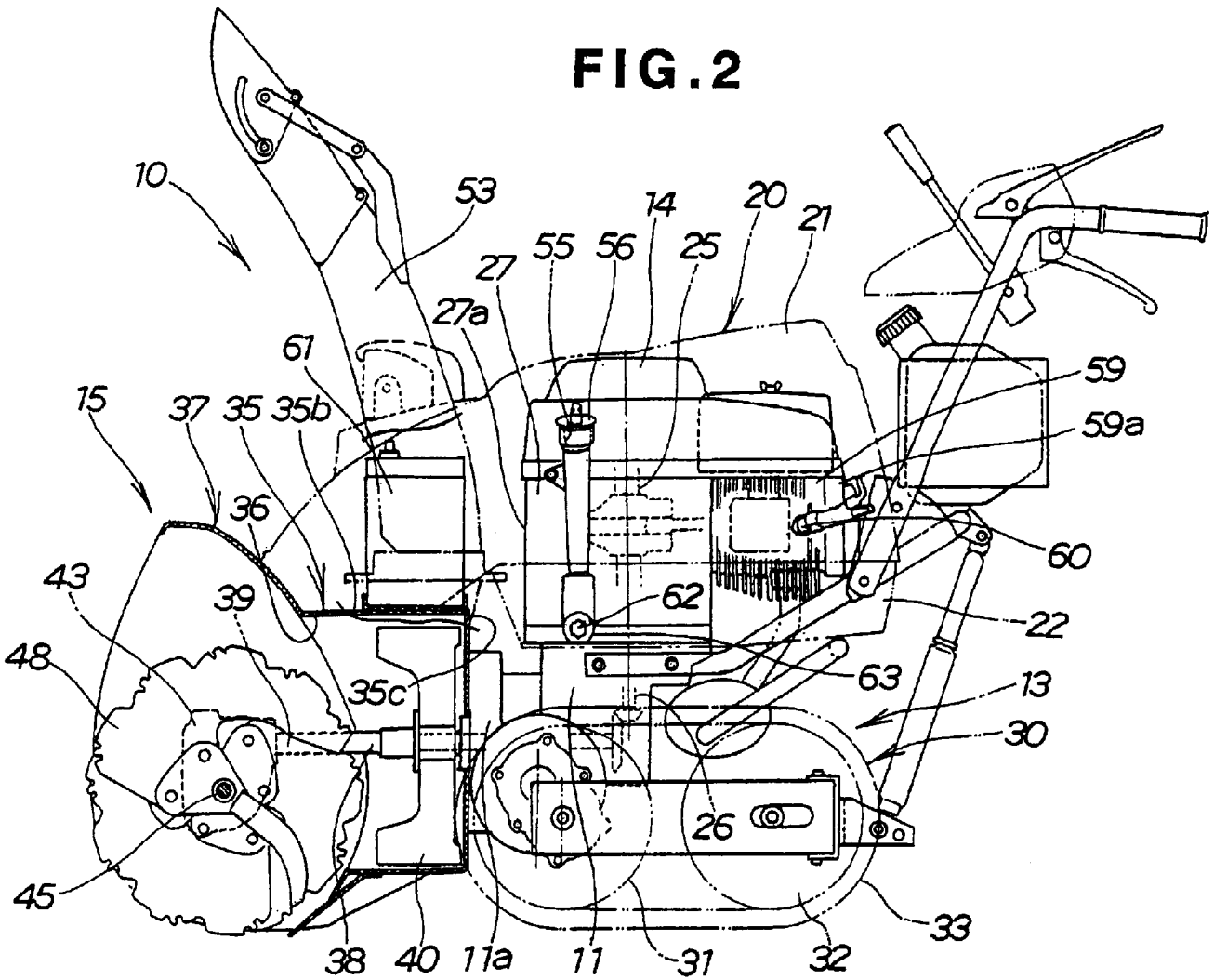
FIG. 2 is a side view of the snow removal machine shown in FIG. 1 with a cover removed.

FIG. 2 illustrates the side of the snow removal machine 10, showing the removed cover 20 in imaginary lines.

The auger unit 15 includes a blower housing 35 provided at a front portion 11*a* of the machine body 11 and an auger housing 37 provided at a front portion 36 of the blower housing 35.

A drive shaft 38 extends forward from the engine 14, passing through the blower housing 35, and extending into the auger housing 37. A blower 40 disposed within the blower housing 35 is mounted on a middle portion of the drive shaft 38. A distal end portion 39 of the drive shaft 38 is connected to a power transmission 43 disposed in the transverse center. Left and right auger shafts 45, 46 (see FIG. 1 for the right auger shaft 46) extend left and right, respectively, from the power transmission 43. Left and right augers 48, 49 are mounted on the left and right auger shafts 45, 46 (see FIG. 1 for the right auger 49).

The engine 14 is a vertical engine with a crankshaft 25 extended in a vertical direction. The power of the engine 14 is transmitted via an auger driving mechanism 26 housed in the machine body (transmission case) 11 to the drive shaft 38.

The engine 14 is disposed in a manner that a cylinder 59 in which a piston (not shown) reciprocates is oriented rearward. A front surface 27*a* of a crankcase 27 housing the crankshaft 25 is adjacent to the rear of the auger unit 15, that is, a rear surface 35*c* of the blower housing 35.

The drive shaft 38 is rotated by drive of the engine 14 and the blower 40 is rotated by rotation of the drive shaft 38. The left and right auger shafts 45, 46 are rotated via the power transmission 43. The left and right augers 48, 49 are rotated by the rotation of the left and right auger shafts 45, 46.

In this state, the snow removal machine 10 advances, digging the left and right augers 48, 49 into snow to break the snow, and raking the broken snow with the left and right augers 48, 49 into the transverse center. The raked snow is whirled up by the blower 40 and thrown through a chute 53 provided on an upper portion 35*b* of the blower housing 35 to a desired position.

The cover 20 is split into an upper cover portion 21 and a lower cover portion 22.

The upper cover portion 21 covers the engine 14, the upper portion 35*b* of the blower housing 35, an oil filler 55 of the engine 14, a fuel cock 58 (see FIG. 7) for opening and closing a fuel line 57 (see FIG. 7), a spark plug 60 for igniting a fuel mixture in the cylinder 59, and a battery 61 for providing electric current to the spark plug 60. The oil filler 55, fuel cock 58, spark plug 60 and battery 61 receive routine maintenance. The oil filler 55 is usually closed with a cap 56. Portions of the engine 14 and the mounting structure comprised of the mount 90 and the receptacle 91 described below define a support section of the snow removal machine disposed generally around the engine 14 for supporting the corresponding oil filler 55, fuel cock 58, spark plug 60 and battery 61.

Routine-maintenance components such as the oil filler 55, fuel cock 58, spark plug 60 and battery 61 are exposed by removing the upper cover portion 21 from the lower cover portion 22.

At the lower cover portion 22, a drain plug 62 (nonroutine-maintenance component) for draining engine oil is provided.

To change the engine oil, with the upper cover portion 21 removed, a tool is inserted through the gap between the lower cover portion 22 and the engine 14 to remove the drain plug 62 from an oil case 63.

Figure 3:
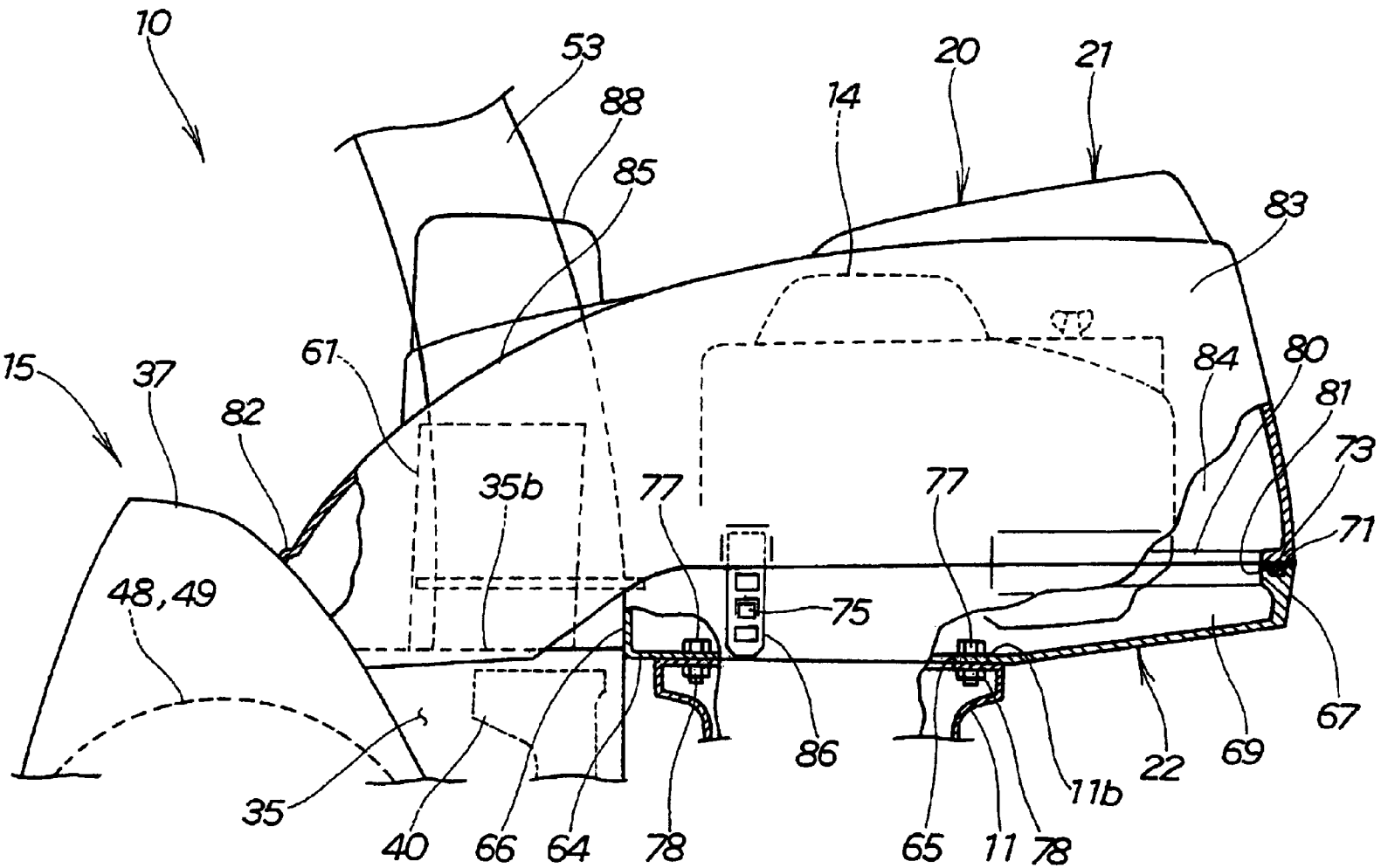
FIG. 3 is a side view of the cover of the snow removal machine shown in FIG. 1.

FIG. 3 illustrates the cover 20 shown in FIG. 1.

Figure 6:
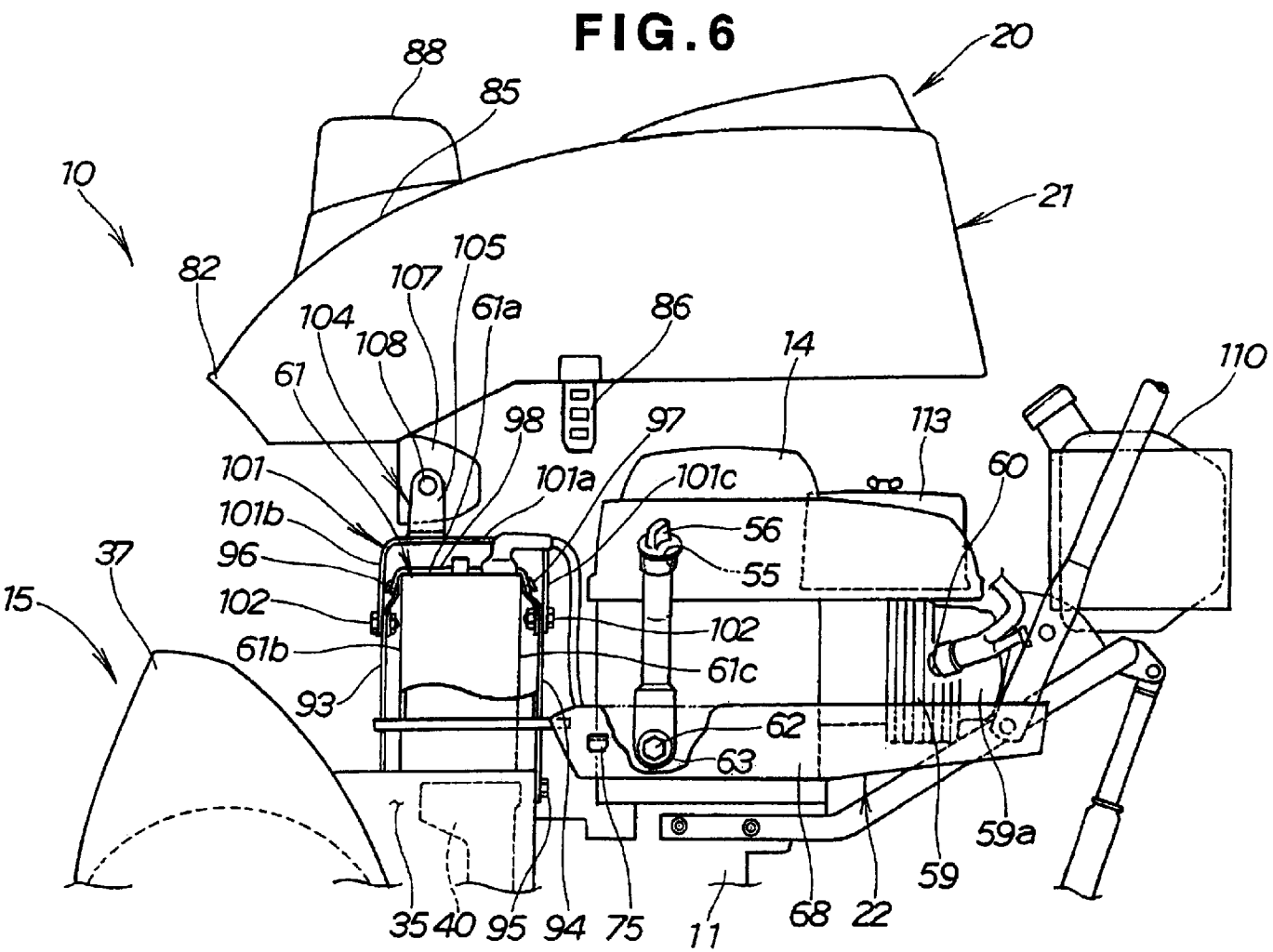
FIG. 6 is a side view illustrating the state in which the upper cover portion of the cover shown in FIG. 3 is removed and the engine, an oil filler, a spark plug and the battery are exposed.

The lower cover portion 22 has a dish-like shape consisting of a bottom 64 formed with an opening 65, front, rear, left and right sidewalls 66, 67, 68 and 69 raised from the front, rear, left and right of the bottom 64 (see FIG. 6 for the left sidewall 68). The sidewalls 66, 67, 68 and 69 have an upper edge 71 formed with a groove. A sealant 73 is put in the groove. Left and right catching claws 75, 76 as first connecting members (see FIG. 7 for the right catching claw 76) are provided in the vicinities of the front edges of the left and right sidewalls 68, 69.

The bottom 64 of the lower cover portion 22 is placed on an upper portion 11*b* of the machine body 11. The bottom 64 is secured to the upper portion 11*b* of the machine body 11 with a plurality of bolts 77 and nuts 78.

The upper cover portion 21 is a member formed in a ship-bottom-like shape and inverted to direct an opening 80 downward. A lower edge 81 is placed on the upper edge 71 of the lower cover portion 22. A front end portion 82 of the upper cover portion 21 abuts on the auger housing 37. Left and right rubber bands 86, 87 as second connecting members (see FIG. 7 for the right rubber band 87) provided at left and right sidewalls 83, 84 of the upper cover portion 21 are caught by the left and right catching claws 75, 76 on the lower cover portion 22. By this construction, the rubber bands and the catching claws define connecting means for removably connecting, the upper cover portion 21 to the lower cover portion 22.

The left and right rubber bands 86, 87 are elastically deformable members. The left and right rubber bands 86, 87 are caught by the left and right catching claws 75, 76 in elastically deformed states. Under the elastic forces of the left and right rubber bands 86, 87, the lower edge 81 of the upper cover portion 21 is pressed against the upper edge 71 of the lower cover portion 22. The lower edge 81 of the upper cover portion 21 and the upper edge 71 of the lower cover portion 22 are hermetically sealed by the sealant 73.

Figure 4:
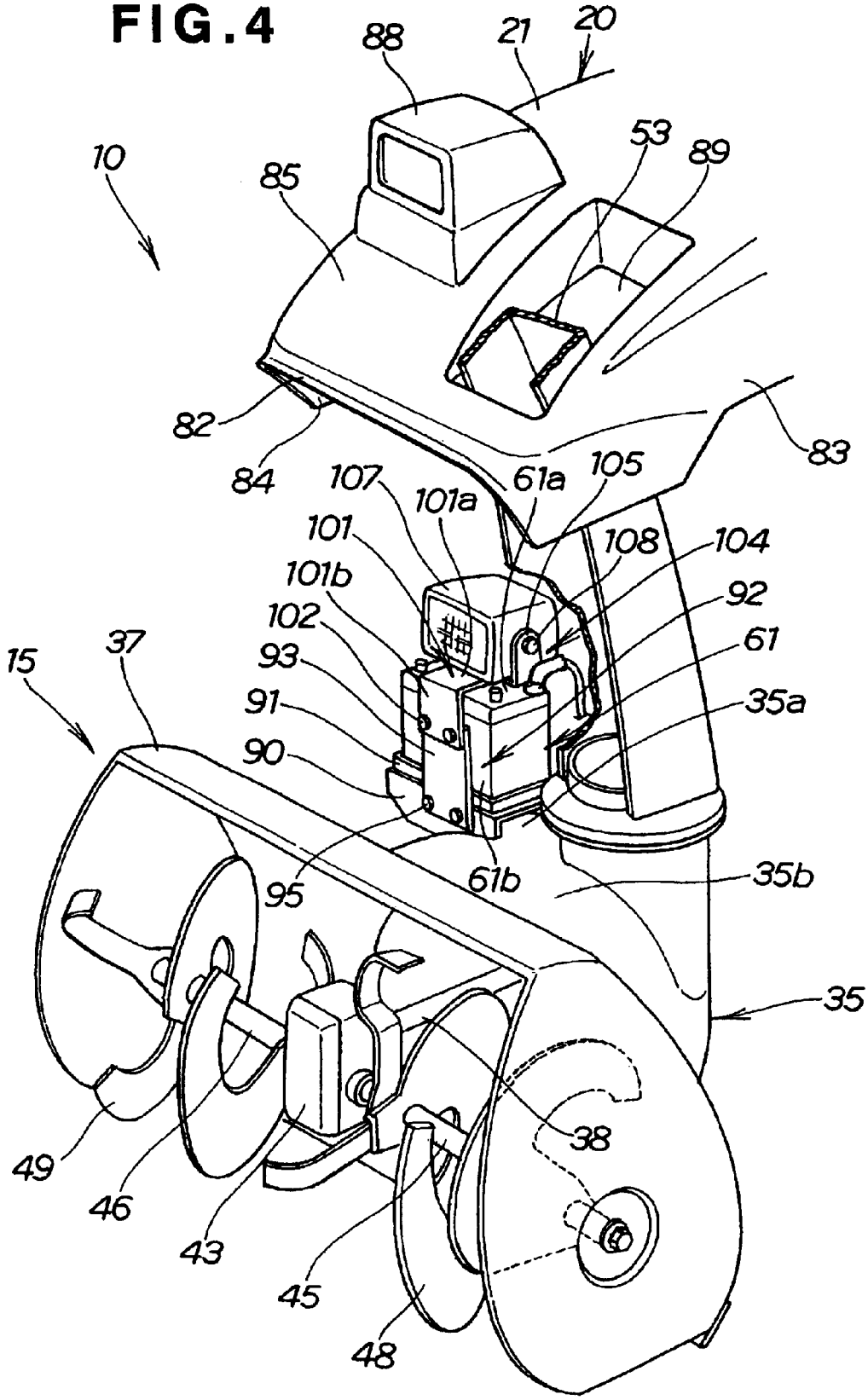
FIG. 4 is a partial perspective view of the snow removal machine, illustrating the mounted state of a battery disposed in front of an engine and provided on an upper portion of a blower housing.

FIG. 4 illustrates the mounting of the battery 61 to the blower housing 35.

The battery 61 is mounted on a receptacle 91 placed on a mount 90 which is provided on a right upper portion 35*a* of the blower housing 35. The battery 61 is secured to the mount 90 with a fastening means 92. A front portion 85 of the upper cover portion 21 of the cover 20 provided on the machine body 11 (see FIG. 3) is extended forward to cover the battery 61 and the upper portion 35*b* of the blower housing 35 with the upper cover front portion 85.

Figure 7:
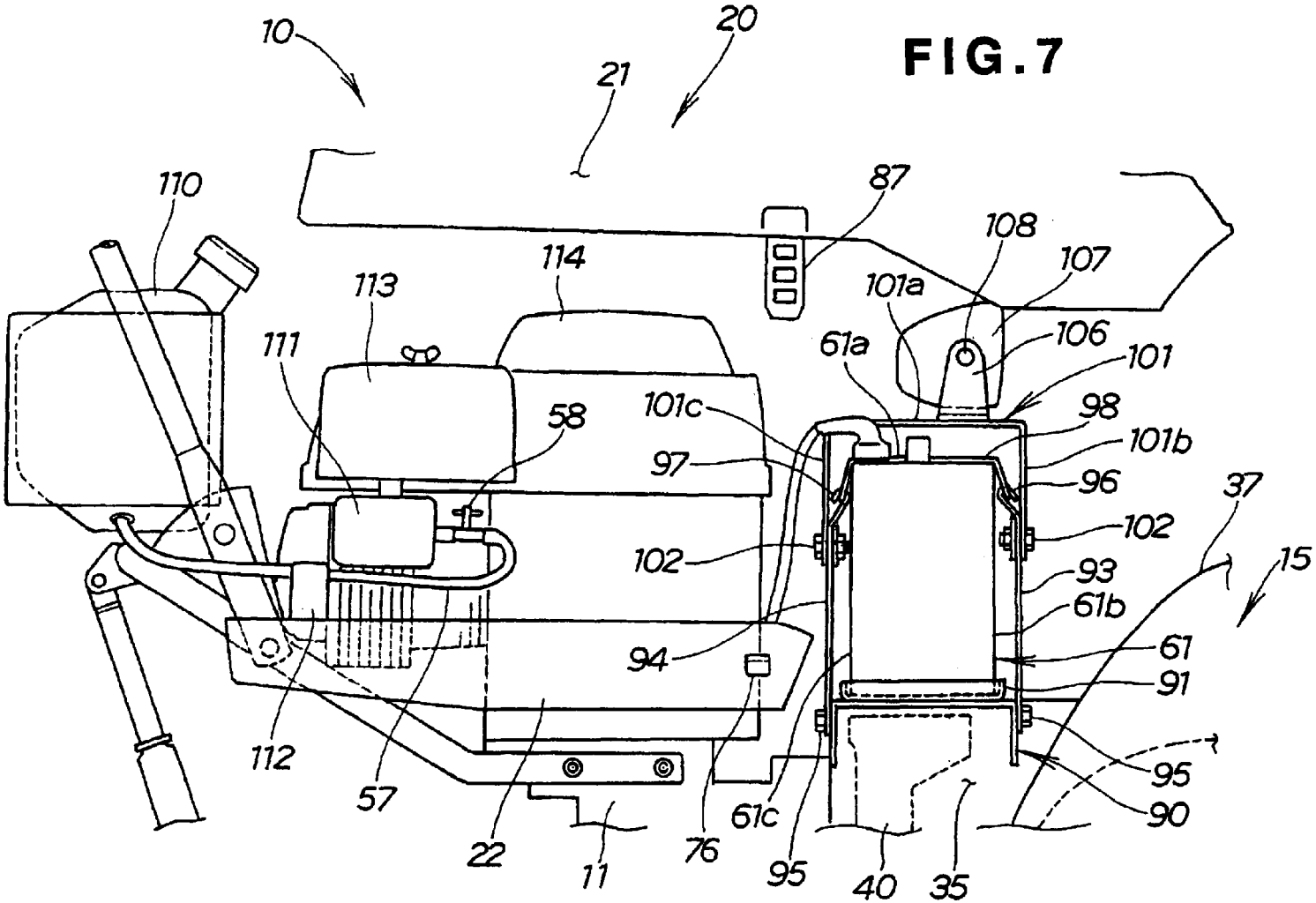
FIG. 7 is a side view taken from the opposite side of the side view of FIG. 6, illustrating the state in which the upper cover portion is removed as in FIG. 6 and a fuel line and a fuel cock are exposed.

The fastening means 92 includes, as shown in FIGS. 6 and 7, front and rear stays 93, 94 attached to the front and rear of the mount 90 with a plurality of bolts 95, and a band 98 extended between front and rear hooks 96, 97 formed at upper end portions of the front and rear stays 93, 94. The band 98 presses an upper portion 61*a* of the battery 61 to secure the battery 61 on the mount 90.

A connecting member 101 for mounting a light 107 above the battery 61 is attached to the upper end portions of the front and rear stays 93, 94 with a plurality of bolts 102. A support bracket 104 for supporting the light 107 is secured to an upper surface 101*a* of the connecting member 101. The light 107 is secured to left and right bent portions 105, 106 (see FIG. 7 for the right bent portion 106) of the support bracket 104 with bolts 108, 108 in a vertically swingable manner.

The light 107 is covered by a light cover 88 integrally formed with the upper cover front portion 85 with the upper cover portion 21 secured to the lower cover portion 22 (see FIG. 3).

The connecting member 101 is formed in a substantially U shape with a front bent portion 101*b*, the upper surface 101*a* and a rear bent portion 101*c* (see FIGS. 6 and 7).

The connecting member 101 is secured to the front and rear stays 93, 94 shown in FIG. 6 with the bolts 102 so that the front stay 93 and the front bent portion 101*b* of the connecting member 101 protect a front portion 61*b* of the battery 61, and the rear stay 94 and the rear bent portion 101*c* of the connecting member 101 protect a rear portion 61*c* of the battery 61 (see FIGS. 6 and 7). The upper portion 61*a* of the battery 61 is protected by the upper surface 101*a* of the connecting member 101.

The chute 53 penetrates through a through hole 89 formed in the upper cover front portion 85 of the upper cover portion 21.

As shown in FIG. 3, the battery 61 mounted on the right upper portion 35*a* of the blower housing 35 and the upper portion 35*b* of the blower housing 35 are covered by the upper cover front portion 85 extending forward of the machine body 11. The battery 61 is thus covered by the upper cover front portion 85 to prevent snow or water from reaching the battery 61, thereby to protect the battery 61 with the upper cover front portion 85. The upper portion 35*b* of the blower housing 35 is covered by the upper cover front portion 85 to prevent outside leakage of frictional noise of air due to the rotation of the blower 40 (see FIG. 2).

In this manner, the cover 20 covers, at the upper cover front portion 85, the battery 61 and the upper portion 35*b* of the blower housing 35 in addition to the engine 14. This eliminates the need for individually preparing a cover for the battery 61 and a cover for the upper portion 35*b* of the blower housing 35, reducing the number of components. Covering the engine 14 with the cover 20 can prevent outside leakage of operating sound produced by the engine 14.

Figure 5B:
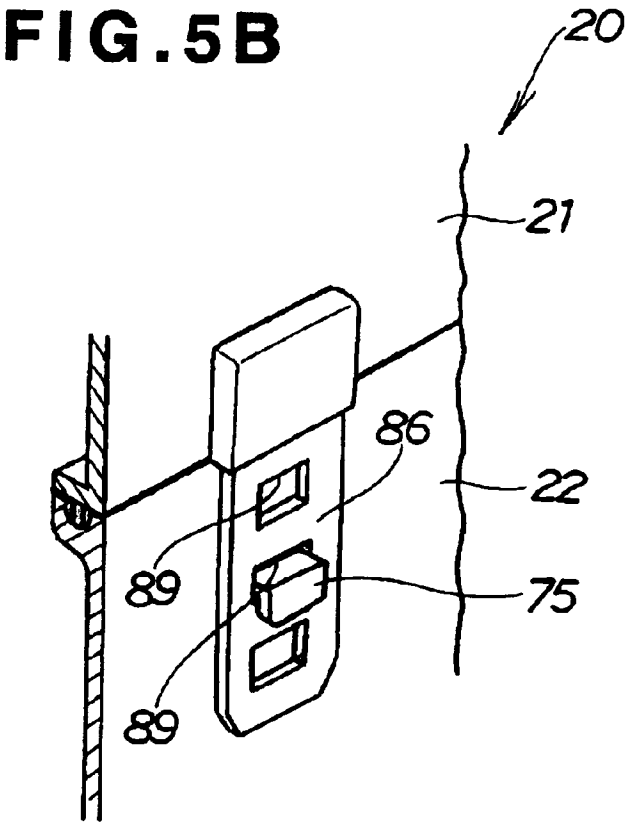
FIGS. 5A and 5B are diagrams illustrating the mounting of an upper cover portion to a lower cover portion shown in FIG. 3.
Figure 5A:
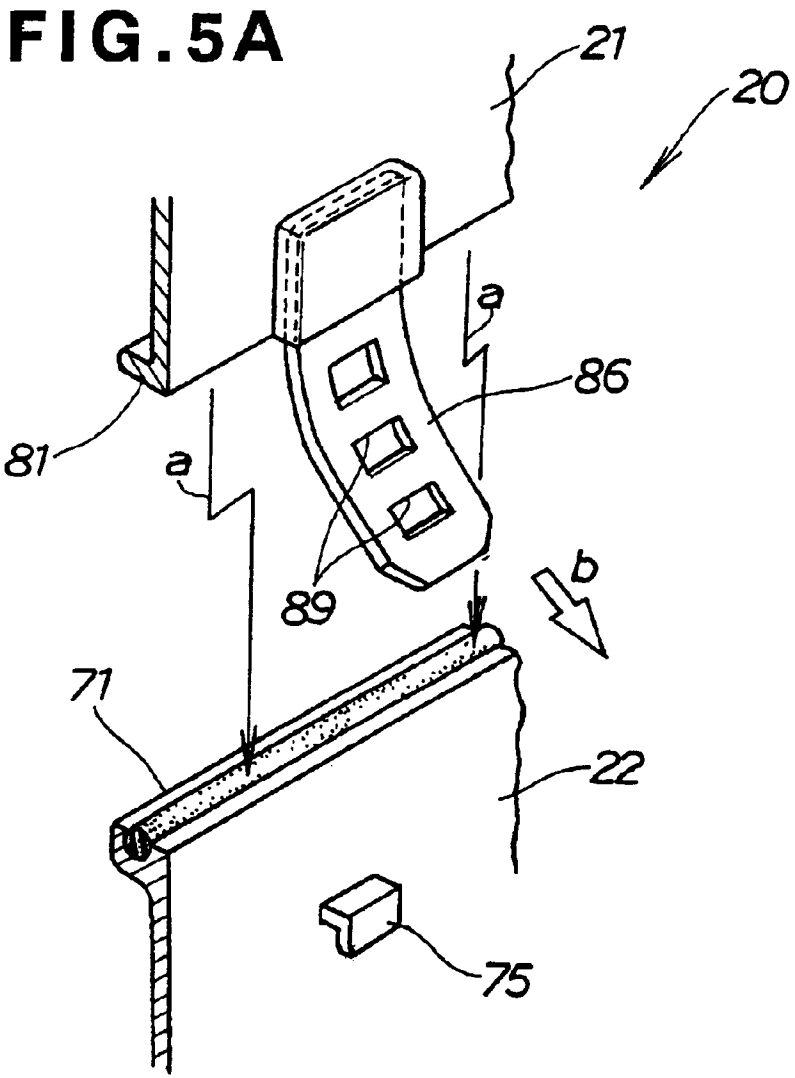

FIGS. 5A and 5B illustrate the rubber band 86 and the catching claw 75 for securing the upper cover portion 21 to the lower cover portion 22.

Referring to FIG. 5A, the lower edge 81 of the upper cover portion 21 is placed on the upper edge 71 of the lower cover portion 22 as shown by arrows a, and then the left and right rubber bands 86, 87 (see FIG. 7 for the right rubber band 87) are held between fingers and pulled as shown by arrow b to be elastically deformed.

Referring to FIG. 5B, respective ones of a plurality of holes 89 formed in the left and right rubber bands 86, 87 are fitted onto the left and right catching claws 75, 76 (see FIG. 7 for the right catching claw 76) provided on the lower cover portion 22. In the embodiment shown in FIG. 5B, the middle holes 89 of the holes 89 in the left and right rubber bands 86, 87 are fitted onto the left and right catching claws 75, 76 on the lower cover portion 22. In this manner, the upper cover portion 21 is secured to the lower cover portion 22.

When removing the upper cover portion 21 from the lower cover portion 22, the left and right rubber bands 86, 87 are held between fingers and pulled to be elastically deformed. Under this state, the holes 89, 89 of the left and right rubber bands 75, 76 are disengaged from the left and right catching claws 75, 76 on the lower cover portion 22. With this, the upper cover portion 21 is removed from the lower cover portion 22.

Thus only fitting or disengaging the holes 89, 89 of the left and right rubber bands 86, 87 onto or from the left and right catching claws 75, 76 on the lower cover portion 22 is required, resulting in easy mounting and demounting of the upper cover portion 21 on or from the lower cover portion 22 without trouble.

Referring to FIG. 6, the upper cover portion 21 is removed from the lower cover portion 22 to expose the oil filler 55, fuel cock 58 (see FIG. 7), spark plug 60 and battery 61. The fuel cock 58 will be described in detail with FIG. 7.

The oil filler 55 is closed with the cap 56. When supplying engine oil, the cap 56 is removed to open the oil filler 55, and engine oil is supplied through the oil filler 55.

For the spark plug 60, it is preferable to increase the frequency of maintenance for good ignition of a fuel mixture in the cylinder 59.

For the battery 61, it is preferable to increase the frequency of maintenance to ensure a required amount of electrolyte for good charge.

For these reasons, the oil filler 55, spark plug 60 and battery 61 are configured to be exposed by removing the upper cover portion 21 from the lower cover portion 22. Only removing the upper cover portion 21 from the lower cover portion allows the oil filler 55, spark plug 60 and battery 61 to be easily exposed, enabling easy maintenance of those routine-maintenance components 55, 60 and 61 without trouble.

The configuration of splitting the cover 20 into two segments, the upper and lower cover portions 21, 22, eliminates the need for providing conventionally required doors for maintenance at the cover 20. The number of components of the cover 20 can thus be reduced for a simplified configuration.

The drain plug 62 (nonroutine-maintenance component) is provided below the engine 14 housed in the lower cover portion 22. When changing the engine oil, with the upper cover portion 21 removed, a tool is inserted through the gap between the lower cover portion 22 and the engine 14 to remove the drain plug 62 from the oil case 63.

The fuel cock 58 shown in FIG. 7 is exposed by removing the upper cover portion 21 from the lower cover portion 22. The fuel cock 58 is provided on a middle portion of the fuel line 57 connecting the fuel tank 110 to a carburetor 111, for example.

By closing the fuel cock 58, the fuel tank 110 is disconnected from the carburetor 111. By opening the fuel cock 58, the fuel tank 110 is connected to the carburetor 111. A filter 112 is provided on a middle portion of the fuel line 57.

The fuel cock 58 is preferably closed when the snow removal machine 10 is not in use. When the snow removal machine 10 is used or not used for long hours (long period), it is required to open or close the fuel cock 58 on each occasion, resulting in frequent opening and closing operations. Only removing the upper cover portion 21, the fuel cock 58 (routine-maintenance component) can be easily opened and closed without trouble.

The air filter 112 connected to the carburetor 111 also receives frequent maintenance. The air filter 113 is also provided in such a manner as to be housed in the upper cover portion 21, so that only removing the upper cover portion 21 allows easy maintenance of the air filter 113 without trouble.

Now a snow removal machine according to a second embodiment of the present invention will be described with reference to FIGS. 8 to 11. Components in the second embodiment identical to those in the first embodiment are given the same reference numerals and will not be described.

Figure 8:
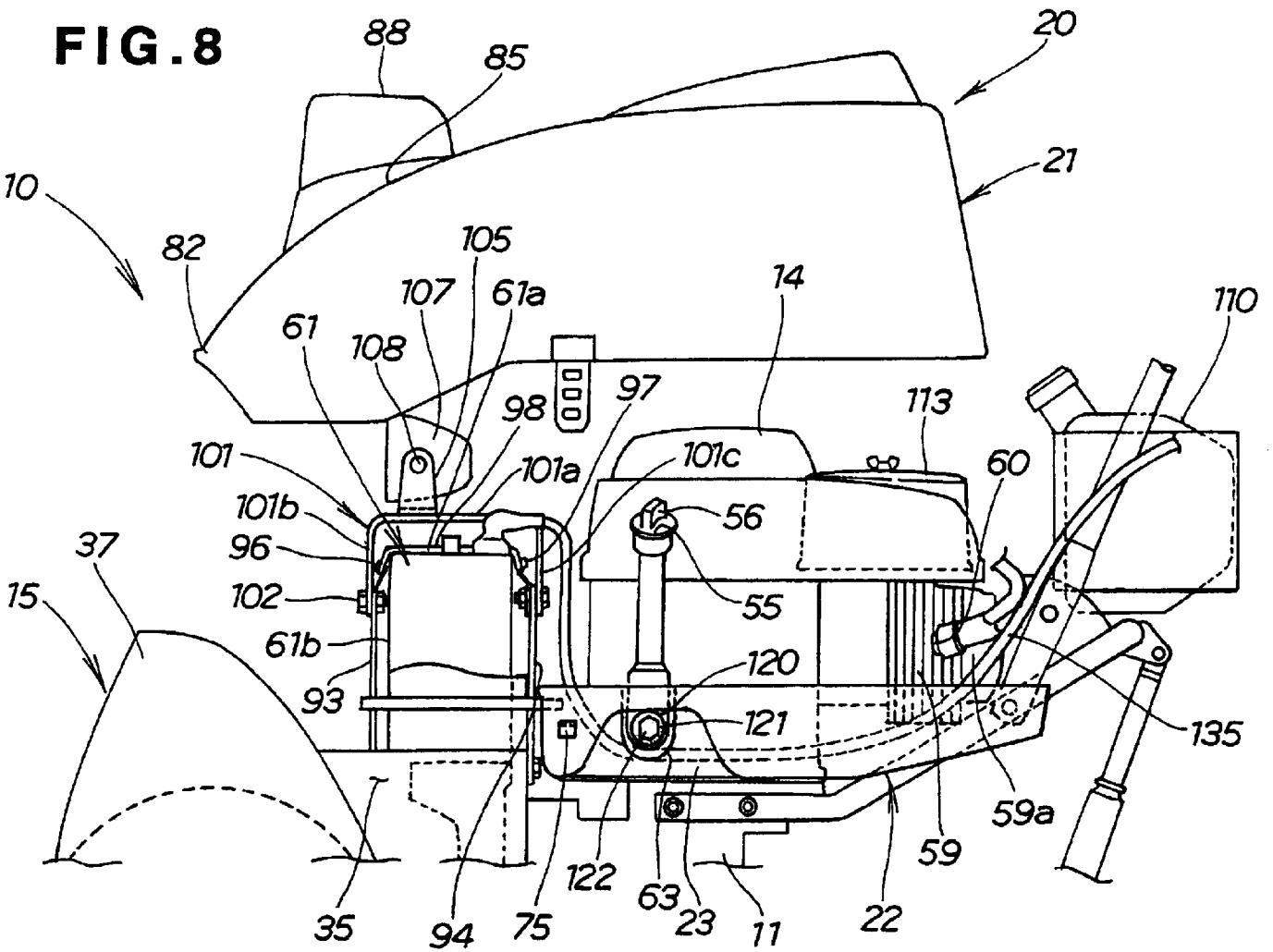
FIG. 8 is a side view of a snow removal machine according to a second embodiment of the present invention with an upper cover portion removed.

FIG. 8 illustrates the snow removal machine in the second embodiment with an upper cover portion removed.

From an oil drain hole 118 (see FIG. 9) provided in an oil case of an engine, a drain pipe 120 is substantially horizontally extended in a transverse direction of a machine body 11. An end 121 of the drain pipe 120 is protruded outside of a left sidewall (sidewall) 23 of a lower cover portion 22. A drain plug 122 is removably fitted to the end 121 of the drain pipe 120.

Figure 9:
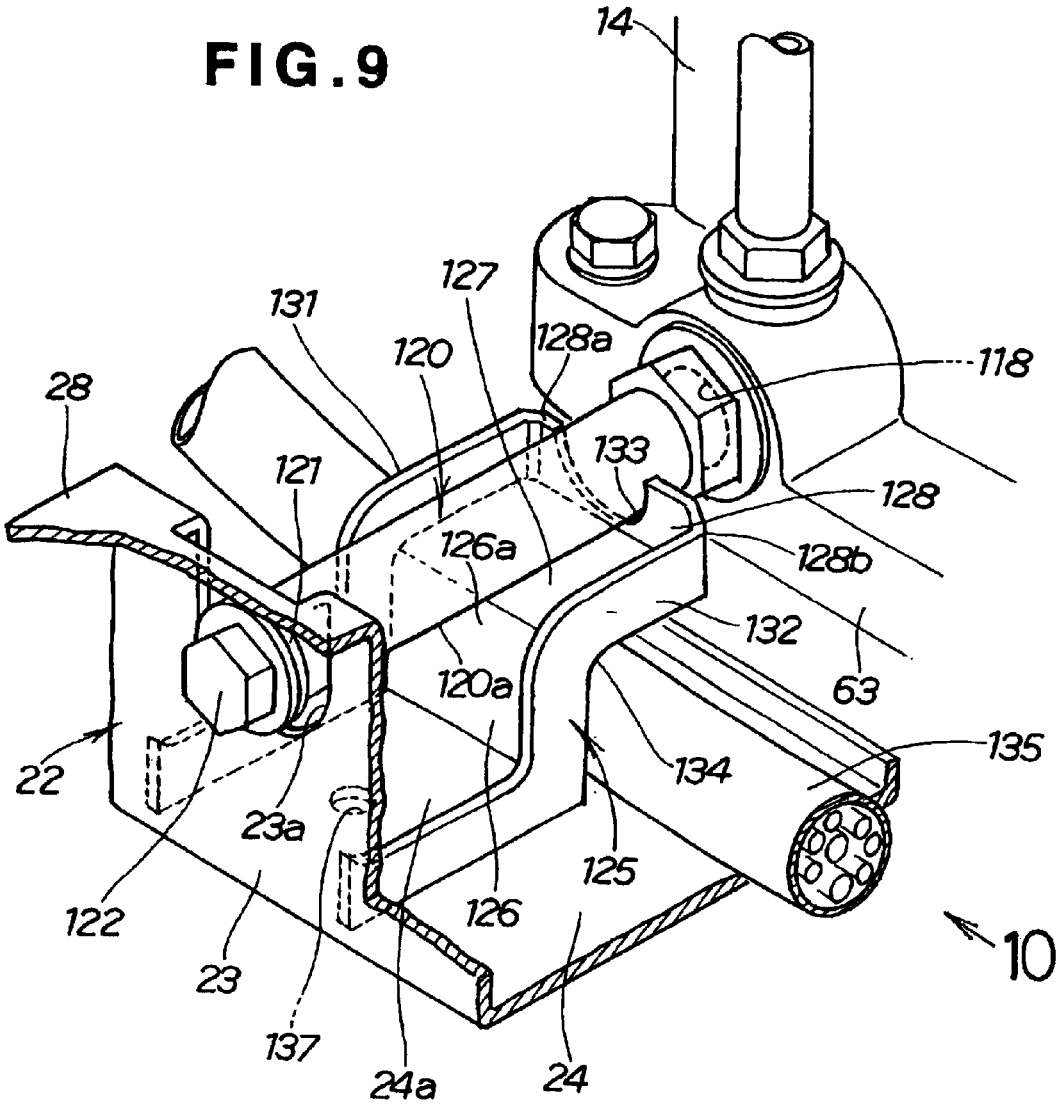
FIG. 9 is a perspective view illustrating the mounted state of a drain pipe extended from an oil drain hole shown in FIG. 8 to a lower cover portion.

FIG. 9 illustrates the mounted state of the drain pipe 120 shown in FIG. 8.

Referring to FIG. 9, from the oil drain hole 118 formed in the oil case 63 of the engine 14, the drain pipe 120 is substantially horizontally extended in a transverse direction of the machine body 11 (see FIG. 8), specifically, leftward.

An opening 23*a* is formed in the left sidewall 23*a* of the lower cover portion 22. The end 121 of the horizontally extending drain pipe 120 is protruded from the opening 23*a* to the outside of the lower cover portion 22. The drain plug 122 is removably fitted to the end 121 of the drain pipe 120 protruded from the opening 23*a*.

An oil receiver 125 receives an engine oil 124 (see FIG. 11) turning around the end 121 of the drain pipe 120 to a periphery 12*a* of the drain pipe 120. The oil receiver 125 is integrally formed on a bottom surface 24 of the lower cover portion 22 to be located below the drain pipe 120.

More specifically, a leg 126 is raised at a substantially middle position between the sidewall 23 of the lower cover portion 22 and the oil case 63, a horizontal portion 127 is extended from the top 126*a* of the leg 126 toward the oil case 63 in parallel with the bottom surface 24, and an end partition 128 is raised on an edge of the horizontal portion 127.

A front partition 128*a* is provided substantially in a crank shape extending from a front edge portion 128*a* of the end partition 128 along the horizontal portion 127, leg 126 and bottom surface 24. A rear partition 132 is provided in a crank shape extending from a rear edge portion 128*b* of the end partition 128 along the horizontal portion 127, leg 126 and bottom surface 24.

The oil receiver 125 is a pan formed in a crank shape, including the front and rear partitions 131, 132, end partition 128, left sidewall 23, bottom 24*a* (bottom surface 24 of the lower cover 22), leg 126 and horizontal portion 127. The bottom 24*a* is a portion of the bottom surface 24 enclosed by the front and rear partitions 131, 132, leg 126 and left sidewall 23.

A discharge opening 137 for discharging the engine oil 124 (see FIG. 11) outside the lower cover portion 22 is formed in the bottom surface 24 of the lower cover portion 22 as a component of the oil receiver 125.

The front and rear partitions 131, 132 and the end partition 128 of the oil receiver 125 have the function of reinforcing the leg 126 and the horizontal portion 127.

A U-shaped support groove 133 is formed in the end partition 128. The drain pipe 120 is put on the support grove 133 for supporting the drain pipe 120 on the end partition 131.

The leg 126 and the horizontal portion 127 of the oil receiver 125 and the bottom surface 24 of the lower cover portion 22 form an retaining hollow 134. The retaining hollow 134 is for fitting a wire harness 135 thereinto. The wire harness 135 is a bundle of wires for connecting electrical components such as the battery 61 and the light 107 (see FIG. 8) provided at the front of the snow removal machine 10 to operating switches and the like provided at the rear of the snow removal machine 10.

Figure 10:
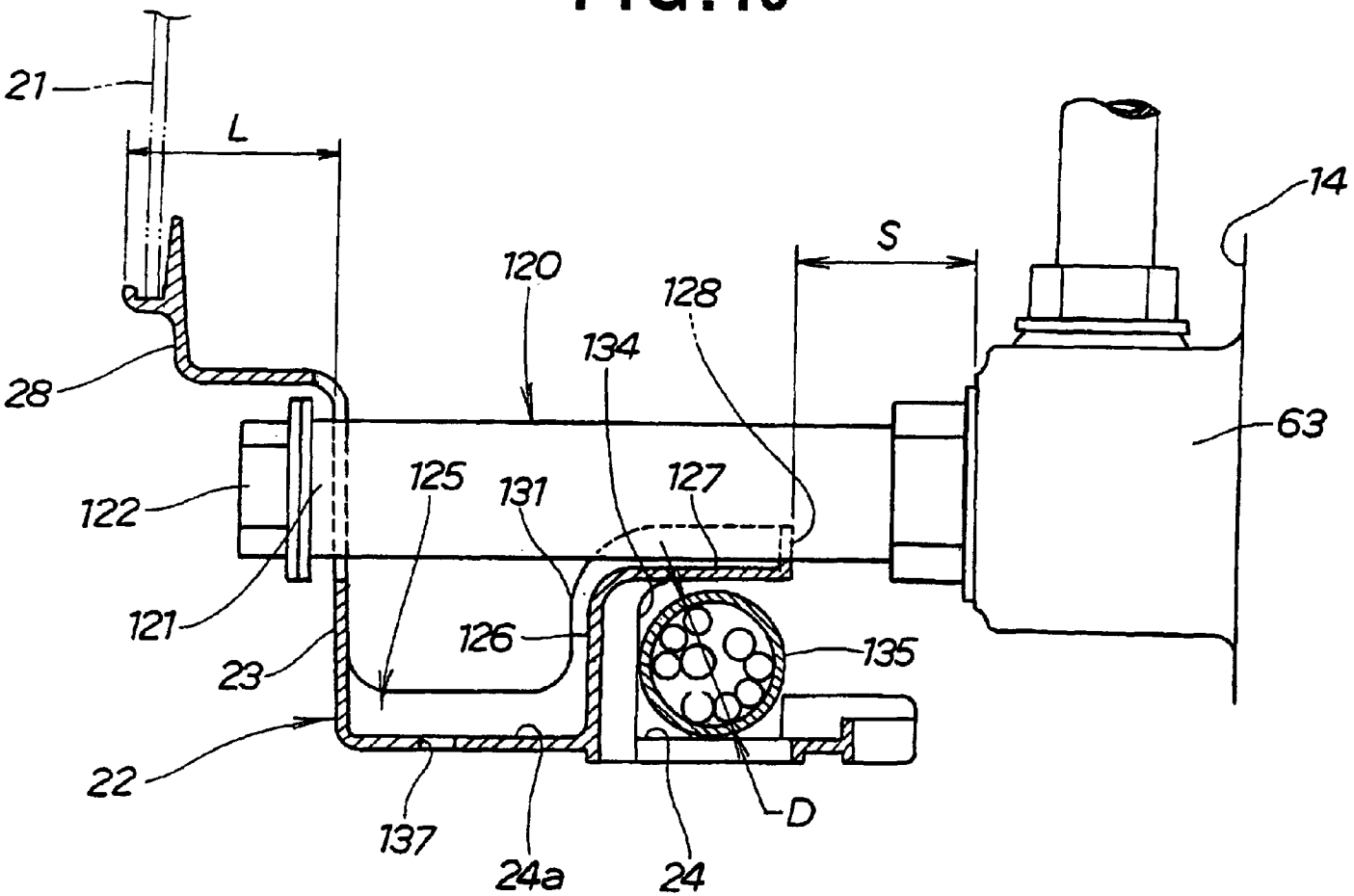
FIG. 10 is a view taken in the direction of arrow 10 in FIG. 9, illustrating the mounted state of a wire harness.

As shown in FIG. 10, the space S between the oil case 63 and the end partition 128 is formed greater than the outside diameter D of the wire harness 135. Before mounting the drain pipe 120 to the oil case 63, the wire harness 135 can be inserted from between the oil case 63 and the end partition 128 into the retaining hollow 134.

An outermost sidewall 28 of the lower cover portion 22 protrudes outward from the sidewall 23 of the lower cover portion 22 by a distance L. The outermost sidewall 28 has the function of eaves, covering the drain plug 122. The drain plug 122 is protected from rain and snow by the outermost sidewall 28 serving as eaves.

Figure 11:
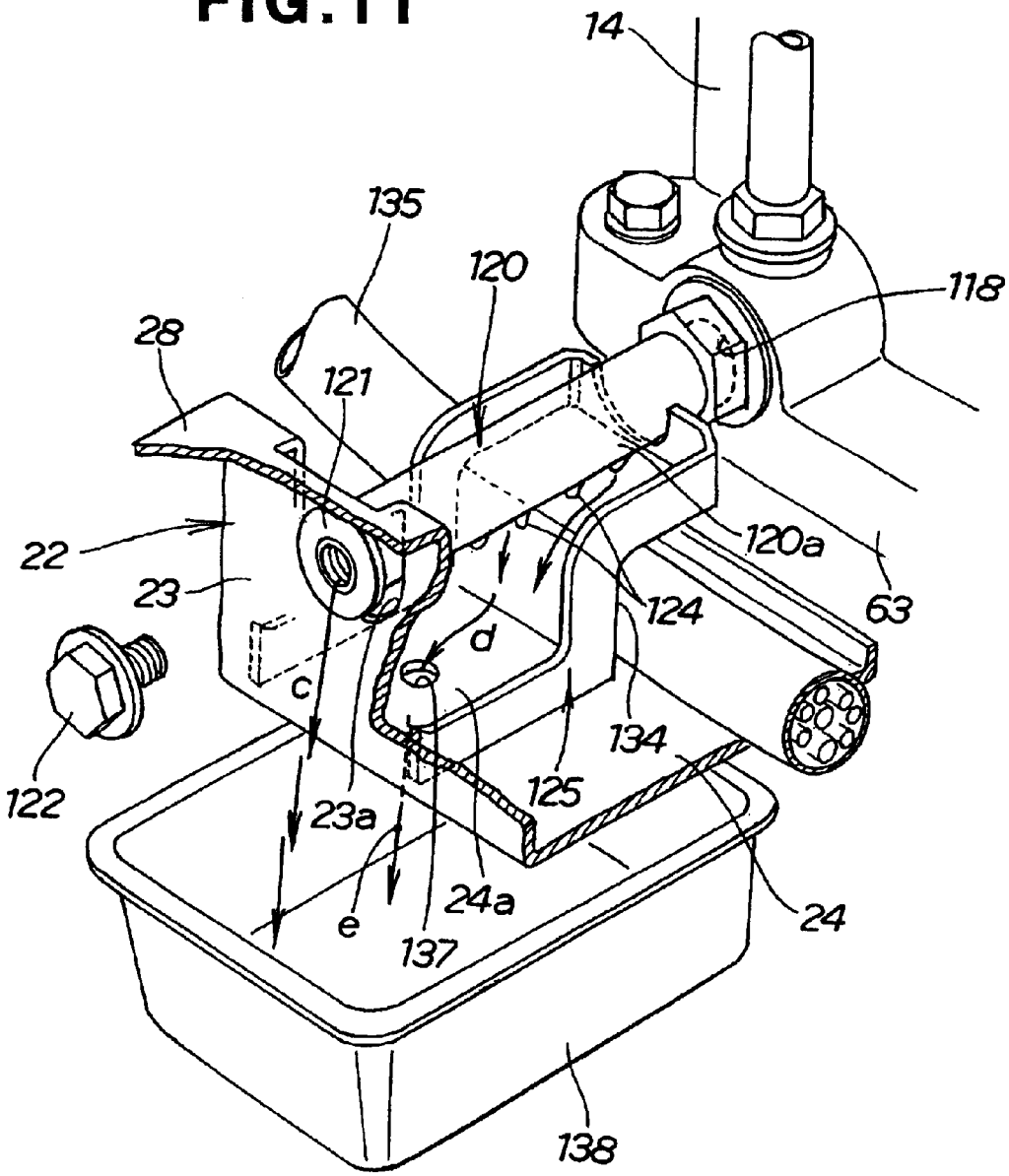
FIG. 11 is a perspective view of the state in which an oil pan for receiving oil is disposed below an end of the drain pipe.
Figure 12:
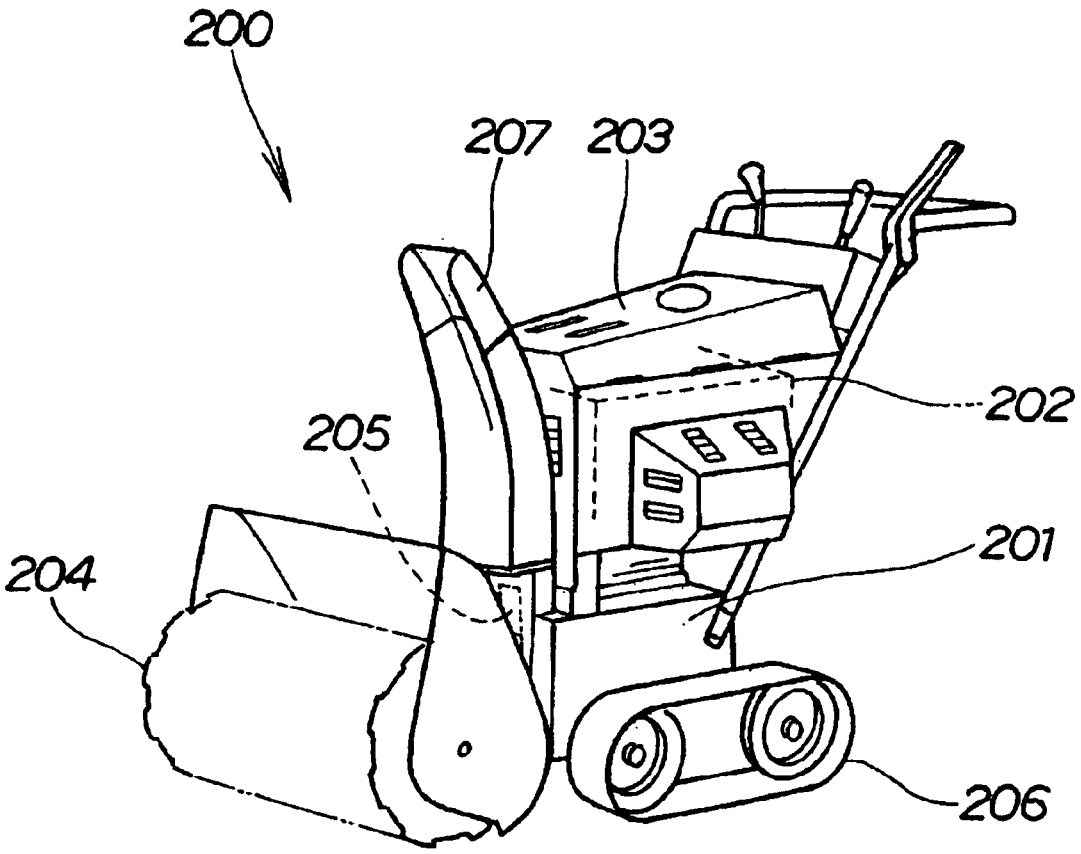
FIG. 12 (PRIOR ART)
FIG. 12 is a perspective view of a conventional snow removal machine.

As shown in FIG. 11, the drain pipe 120 extends from the oil drain hole 118 toward the left sidewall 23 of the lower cover portion 22. The end 121 of the drain pipe 120 protrudes outward of the left sidewall 23 of the lower cover portion 22. The drain plug 122 is removably fitted to the end 121. The drain plug 122 can thus be removed from the outside of the cover 20 (see FIG. 8) without removing the upper cover portion 21 (see FIG. 8) and the lower cover portion 22.

An oil pan 138 is placed below the end 121 of the drain pipe 120. The engine oil 124 runs out of the drain pipe 120 as shown by arrows c, discharged into the oil pan 138.

Since the oil receiver 125 is formed on the lower cover portion 22 below the drain pipe 120, when the drain plug 122 is removed to drain the engine oil 124, part of the engine oil 124 turning around the end 121 of the drain pipe 120 to the periphery 120*a* is received on the oil receiver 125 as shown by arrows d. The oil receiver 125 prevents the engine oil 124 from spreading within the lower cover portion 22.

Since the discharge opening 137 is formed in the bottom 24*a* of the oil receiver 125, the engine oil 124 received on the oil receiver 125 is discharged through the discharge opening 137 into the oil pan 138 as shown by an arrow e without removing the cover 20.

The wire harness 135 is fitted into the retaining hollow 134 formed by the oil receiver 125 and the bottom surface 24 of the lower cover portion 22 to be retained. Member used for retaining the wire harness 135 can also be used for the oil receiver 125, leading to a simplified configuration.

Although the above embodiments have been described with an example of engaging the left and right rubber bands 86, 87 with the left and right catching claws 75, 76 for securing the upper cover portion 21 to the lower cover portion 22, the present invention is not limited thereto. Other engaging means such as hooks may alternatively be used.

The upper cover portion 21 and the lower cover portion 22 shown in the above embodiments may have any shapes.

The above embodiments have been described on the snow removal machine 10 provided with the auger unit 15 exemplifying a snow removing section, which is not limiting. The present invention is also applicable to snow removal machines with a snow-removing bulldozer. In this case, an engine is used in place of electric motors for the drive source of the running section 13.

Obviously, various minor changes and modifications of the present invention are possible in the light of the above teaching. It is therefore to be understood that within the scope of the appended claims the invention may be practiced otherwise than as specifically described.

What is claimed is:

1. A snow removal machine comprising:

a machine body;

a snow removing section disposed at a front portion of the machine body for removing snow while the snow removal machine travels along a ground surface;

a blower disposed between the machine body and the snow removing section for blowing snow removed by the snow removing section;

a running section disposed below the machine body for undergoing movement to cause the snow removal machine to travel along the ground;

an engine mounted on the machine body for driving the snow removing section and the blower;

a support section disposed generally around the engine and supporting an oil filler for supplying oil to the engine, a fuel cock for opening and closing a fuel line, a spark plug for igniting a fuel mixture within a cylinder, and a battery for providing electric current to the spark plug; and a cover having a lower cover portion mounted on the machine body and an upper cover portion removably connected to the lower cover portion to cover the engine, the oil filler, the fuel cock, the spark plug and the battery and to allow disconnection of the upper cover portion from the lower cover portion to expose and provide access to the oil filler, the fuel cock, the spark plug and the battery.

2. A snow removal machine as set forth in claim 1; wherein the engine has an oil drain hole; and further comprising a drain pipe extending in a direction generally transverse to the machine body and having an end protruding outwardly from a sidewall of the lower cover portion, a drain plug removably fitted to the end of the drain pipe, and an oil receiver disposed below the drain pipe for receiving oil turning around the end of the drain pipe to a periphery of the drain pipe, the oil receiver being connected to the lower cover portion to form with the lower cover portion a retaining hollow portion for retaining therein a wire harness.

3. A snow removal machine as set forth in claim 2; wherein the oil receiver has a discharge opening formed in a bottom portion thereof for discharging oil from the oil receiver.

4. A snow removal machine as set forth in claim 1; further comprising a blower housing disposed at a front portion of the machine body for enclosing the blower, and a mounting member disposed on an upper portion of the blower housing for supporting the battery; wherein the upper cover portion is connected to the lower cover portion so that the upper cover portion covers the blower housing and the battery supported by the mounting member.

5. A snow removal machine as set forth in claim 1; wherein the lower cover portion of the cover comprises a bottom wall connected to the machine body and a plurality of side walls defining an upper edge; and wherein the upper cover portion of the cover comprises a plurality of wall portions defining a lower edge disposed on the upper edge of the lower cover portion to cover the engine, the oil filler, the fuel cock, the spark plug and the battery when the upper cover portion is connected to the lower cover portion.

6. A snow removal machine according to claim 5; further comprising connecting means for removably connecting the upper cover portion of the cover to the lower cover portion of the cover.

7. A snow removal machine according to claim 6; wherein the connecting means comprises at least one catching claw disposed on the lower cover portion and at least one elastic member disposed on the upper cover portion for removable engagement with the catching claw of the lower cover portion.

8. A snow removal machine according to claim 1; further comprising a blower housing disposed at a front portion of the machine body for covering the blower; and wherein the upper cover portion has a front portion for covering an upper portion of the blower housing when the upper cover portion is connected to the lower cover portion.

9. A snow removal machine comprising:

a machine body;

a snow removing section mounted on the machine body for removing snow while the snow removal machine travels along a ground surface;

a running section mounted on the machine body for undergoing movement to cause the snow removal machine to travel along the ground surface;

an engine mounted on the machine body for driving the snow removing section;

an oil filler for supplying oil to the engine;

a fuel cock for opening and closing a fuel line supply to the engine;

a spark plug for igniting a fuel mixture within a cylinder of the engine;

a cover having a first cover portion and a second cover portion; and connecting means for connecting the second cover portion to the first cover portion to cover the engine, the oil filler, the fuel cock and the spark plug and for allowing disconnection of the second cover portion from the first cover portion to expose and provide access to the engine, the oil filler, the fuel cock and the spark plug.

10. A snow removal machine according to claim 9; further comprising a blower disposed between the machine body and the snow removing section for blowing snow removed by the snow removing section, and a blower housing disposed at a front portion of the machine body for covering the blower; and wherein the second cover portion has a front portion for covering an upper portion of the blower housing when the second cover portion is connected to the first cover portion.

11. A snow removal machine according to claim 10; further comprising a battery for providing electric current to the spark plug; and a mounting member disposed on the upper portion of the blower housing for supporting the battery so that the second cover portion covers the battery when the second cover portion is connected to the first cover portion.

12. A snow removal machine according to claim 9; further comprising a battery for providing electric current to the spark plug and a mounting member for supporting the battery, the second cover portion being configured to cover the battery when the second cover portion is connected to the first cover portion and to expose and allow access to the battery when the second cover portion is disconnected from the first cover portion.

13. A snow removal machine according to claim 9; wherein the first cover portion comprises a bottom wall connected to the machine body and a plurality of side walls defining an upper edge; and wherein the second cover portion comprises a plurality of wall portions defining a lower edge disposed on the upper edge of the first cover portion to cover the engine, the oil filler, the fuel cock, and the spark plug when the second cover portion is connected to the first cover portion.

14. A snow removal machine according to claim 9; wherein the connecting means comprises at least one catching claw disposed on the first cover portion and at least one elastic member disposed on the second cover portion for removable engagement with the catching claw of the first cover portion.

15. A snow removal machine according to claim 9; wherein the first cover portion is mounted on the machine body.

16. A snow removal machine comprising:

a machine body;

a snow removing section mounted on the machine body for removing snow while the snow removal machine travels along a ground surface;

a running section mounted on the machine body for undergoing movement to cause the snow removal machine to travel along the ground surface;

an engine mounted on the machine body for driving the snow removing section;

an oil filler for supplying oil to the engine;

a fuel cock for opening and closing a fuel line supply to the engine;

a spark plug for igniting a fuel mixture within a cylinder of the engine;

a cover having a single first cover portion and a single second cover portion;

a first connecting member mounted on the first cover portion;

a second connecting member mounted on the second cover portion for removable engagement with the first connecting member to removably connect the second cover portion to the first cover portion to cover the engine, the oil filler, the fuel cock and the spark plug, the second connecting member being configured to be readily disengaged from the first connecting member to allow disconnection of the second cover portion from the first cover portion to expose and provide access to the engine, the oil filler, the fuel cock and the spark plug.

17. A snow removal machine according to claim 16; further comprising a blower disposed between the machine body and the snow removing section for blowing snow removed by the snow removing section, and a blower housing disposed at a front portion of the machine body for covering the blower; and wherein the second cover portion has a front portion for covering an upper portion of the blower housing when the second cover portion is connected to the first cover portion.

18. A snow removal machine according to claim 16; further comprising a battery for providing electric current to the spark plug and a mounting member for supporting the battery, the second cover portion being configured to cover the battery when the second cover portion is connected to the first cover portion and to expose and allow access to the battery when the second cover portion is disconnected from the first cover portion.

19. A snow removal machine according to claim 16; wherein the first cover portion comprises a bottom wall connected to the machine body and a plurality of side walls defining an upper edge; and wherein the second cover portion comprises a plurality of wall portions defining a lower edge disposed on the upper edge of the first cover portion to cover the engine, the oil filler, the fuel cock, and the spark plug when the second cover portion is connected to the first cover portion.

20. A snow removal machine according to claim 16; wherein the first cover portion is mounted on the machine body.

* * * * *